US006169532B1

(12) United States Patent
Sumi et al.

(10) Patent No.: US 6,169,532 B1
(45) Date of Patent: Jan. 2, 2001

(54) DISPLAY APPARATUS AND METHOD FOR DRIVING THE DISPLAY APPARATUS

(75) Inventors: Shinobu Sumi; Minoru Kanbara, both of Tokyo (JP)

(73) Assignee: Casio Computer Co., Ltd., Tokyo (JP)

( * ) Notice: Under 35 U.S.C. 154(b), the term of this patent shall be extended for 0 days.

(21) Appl. No.: 09/017,653

(22) Filed: Feb. 2, 1998

(30) Foreign Application Priority Data

Feb. 3, 1997 (JP) ..... 9-032611

(51) Int. Cl.[7] ..... G09G 3/36

(52) U.S. Cl. ..... 345/98; 345/97; 345/99; 345/212

(58) Field of Search ..... 345/98, 97, 99, 345/212, 211, 100, 205

(56) References Cited

U.S. PATENT DOCUMENTS 4,430,648 * 2/1984 Togashi et al. ..... 345/205
4,571,584 * 2/1986 Suzuki ..... 345/94
4,660,030 * 4/1987 Maezawa ..... 345/91
4,803,480 * 2/1989 Soneda et al. ..... 345/100
5,724,061 3/1998 Kanbara ..... 345/100
5,828,367 * 10/1998 Kuga ..... 345/211

* cited by examiner

*Primary Examiner*—William A. Cuchlinski, Jr.
*Assistant Examiner*—Marthe Y. Marc-Coleman
(74) *Attorney, Agent, or Firm*—Pennie & Edmonds LLP

(57) ABSTRACT

A display apparatus comprises a liquid crystal display panel, gate driver circuit for scanning gate lines of the display panel, drain driver circuit for supplying the display data to drain lines of the display panel, level modulator circuit coupled to the display panel and control circuit. The control circuit determines that video data represents a still image data, stoped the operation of the drain driver circuit and activates the level modulator circuit. The level modulator circuit reads out from display signals from the display panel and re-writes display signals to the display panel in order to display the still image on the display panel. In this manner, the electric power consumed by the drain circuit can be conserved when the display apparatus displays the still image.

24 Claims, 11 Drawing Sheets

DISPLAY APPARATUS AND METHOD FOR DRIVING THE DISPLAY APPARATUS

BACKGROUND OF THE INVENTION

1. Field of the Invention

The present invention relates to a display apparatus and method for driving the display apparatus, and more particularly to a display apparatus and method for driving the display apparatus for displaying a still image.

2. Description of the Prior Art

Recently, a liquid crystal display apparatus has come into use in various products, such as personal computers, VCRs and digital still cameras. Most liquid crystal display apparatus adopt an active matrix driving system.

The active matrix liquid crystal display apparatus includes switching elements, such as thin film transistors (TFTs), which connect to picture element electrodes. The TFTs also connect to a gate driver by way of scanning (gate) lines and a drain driver by way of drain lines. The gate driver sequentially selects scanning lines in the manner of the line-sequential scanning in order to make on-state of the TFTs which are connected to the selected scanning line. The drain driver includes a shift register and a latch circuit. The shift register has the same number of stages as the number of the picture element electrodes coupled to one scanning line by way of the TFTs. Each stage of the shift register has a plurality of complimentary metal oxide semiconductor (CMOS) transistors and outputs a shift clock to the latch circuit. During a period in which the gate driver selects one scanning line, the display signals corresponding to one scanning line sequentially shift in the latch circuit based on the shift clock output from the shift register and are output from the latch circuit to the picture element electrodes coupled to the scanning line selected by the gate driver through the TFTs.

In the meantime, a CMOS transistor, comprising an n-type metal oxide semiconductor (NMOS) and a p-type metal oxide semiconductor (PMOS), consumes electric power at the moment of its switching operation since the current flows through both the NMOS and PMOS at the moment of being inverted the gate signal. Therefore, in high frequency operation, the CMOS consumes a large amount of the electric power.

In the display apparatus set forth above, a drain drivers utilizing many CMOS's consume a relatively large amount of electric power since these drain drivers operate with high frequency. Particularly, in a display apparatus with high resolution, as the frequency to operate the drain driver increases, the electric power consumed by the drain driver increases. The drain driver actually consumes most of the electric power consumed by a circuit for driving the liquid crystal display panel. For example, in certain models of commercial liquid crystal televisions, the gate driver operates with a frequency of 16 kHz and a current of 900 $\mu$A, while the drain drive operates with a frequency of 4 MHz and a current of 10 mA.

The active matrix liquid crystal display apparatus set forth above always performs the same operation whether it displays motion image data or still image data. That is, when the display apparatus displays the still image, a plurality of the same image data is repeatedly supplied to the picture element electrodes every frame by using the drain driver which consumes a large amount of the electric power.

An organic electroluminescent (EL) display apparatus and a light emitted diode (LED) display apparatus also have a drain driver which is similar to that of the liquid crystal display apparatus and perform the same operation whether they display a motion image data or a still image data. Thus, there is a need for improvements in energy usage of such devices.

SUMMARY OF THE INVENTION

The present invention provides a display apparatus and method for driving the display apparatus which conserve electric power when the display apparatus displays still image data. This is achieved by a display apparatus which comprises a display panel for displaying image data, which panel has a plurality of picture element electrodes arranged in matrix having rows and columns; image data processing means for producing a display signal of one line from the image data; scanning means for selecting the picture element electrodes on one of the rows of the display panel in sequence; display signal supplying means for supplying display signals produced by the image data processing means to the picture element electrodes selected by the scanning means; determining means for determining whether the image data represents a still image; and control means for stoping the operation of the display signal supplying means when the determining means determines that the image data represents a still image.

The present invention also provides a method for driving a display apparatus of the type described above. The method comprises an image data processing step of producing a display signal of one line from the image data; a scanning step of selecting the picture element electrodes on one of the rows of the display panel in sequence; a display signal supplying step of supplying display signal produced by the image data processing step to the picture element electrodes selected by the scanning step; a determining step of determining whether the image data represents a still image; and control step of stoping the operation of the display signal supplying step when the image data represents the still image.

DETAILED DESCRIPTION OF THE PREFERRED EMBODIMENTS OF THE PRESENT INVENTION

Preferred embodiments of the present invention will be described referring to FIGS. 1–13 as follows.

First Embodiment

This embodiment represents a liquid crystal display (LCD) apparatus employing the present invention, which includes a monochrome monitor which displays data in only black and white.

Figure 1:
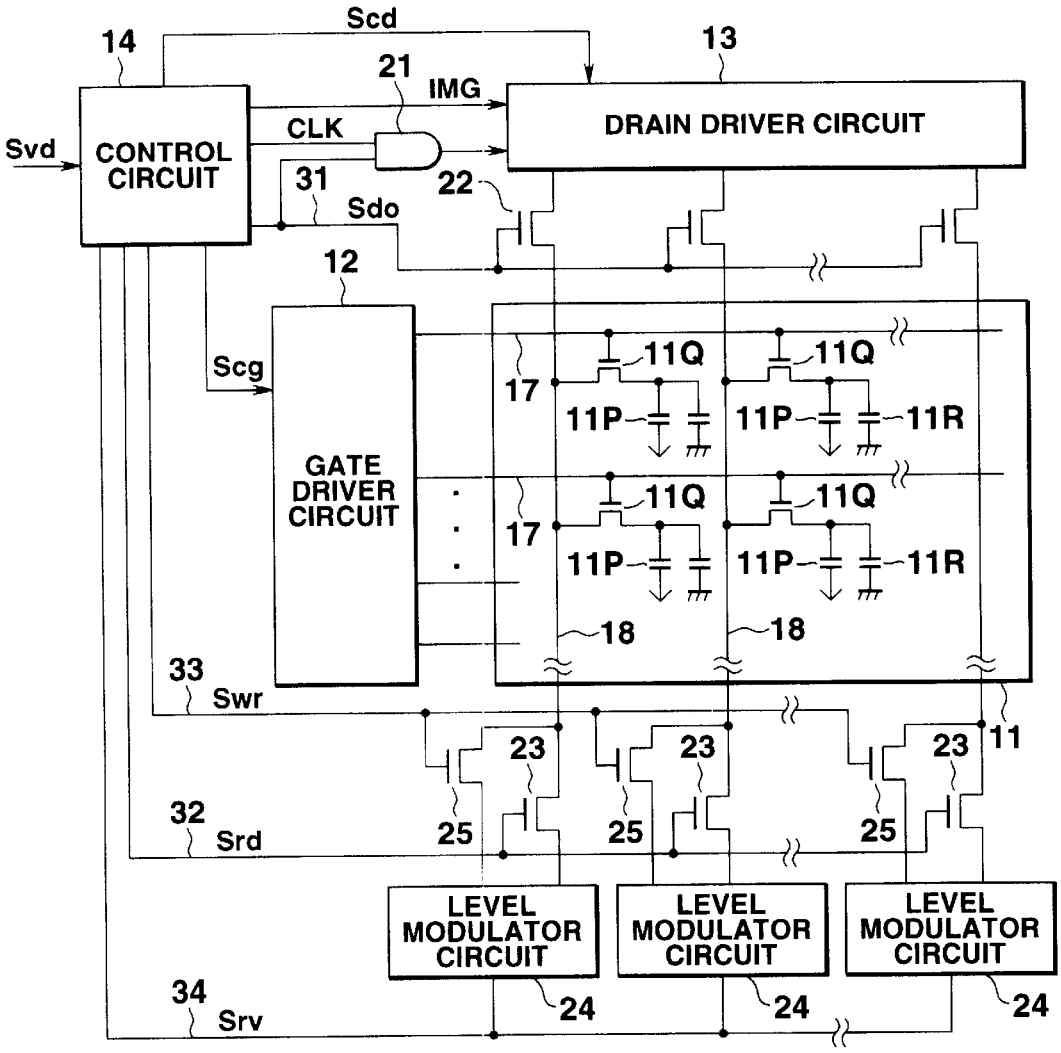
FIG. 1 is a block diagram of a liquid crystal display apparatus employing the present invention.

FIG. 1 is a schematic representation of the LCD apparatus of the first embodiment. The LCD apparatus comprises an LCD panel 11, a gate driver circuit 12, a drain driver circuit 13, level modulator circuits 24 and a control circuit 14. The gate driver circuit 12 couples to gate lines 17 of the LCD panel 11. The drain driver circuit 13 couples to drain lines 18 of the LCD panel 11 by way of display signal cutting switches 22. The level modulator circuits 24 also couple to the drain lines 18 of the LCD panel 11 by way of reading switches 23 and re-writing switches 25. The control circuit 14 couples to the gate driver circuit 12, the drain driver circuit 13, the level modulator circuit 24, the display signal cutting switches 22, the reading switches 23 and the re-writing switches 25, respectively.

Figure 2:
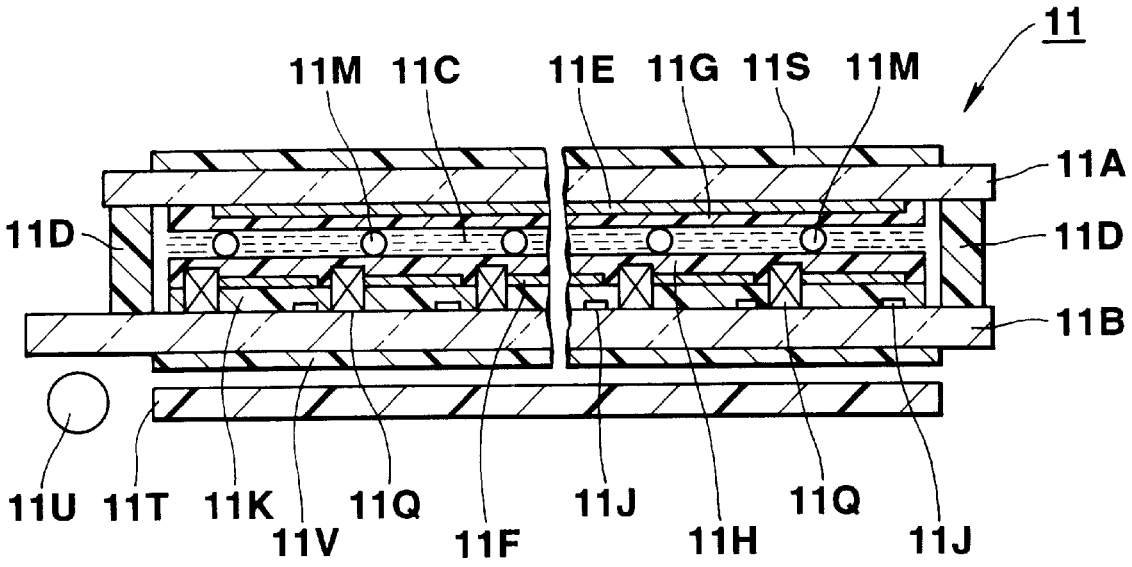
FIG. 2 is a section view of a liquid crystal display panel of the liquid crystal display apparatus shown in FIG. 1.

In FIG. 2, the display panel 11 includes liquid crystal material 11C filled in a gap between a pair of transparent substrates 11A and 11B which are sealed by a sealing member 11D. On the inner surface of the transparent substrate 11A, a common electrode 11E are arranged. On the inner surface of the transparent substrate 11B, compensating capacitance electrodes 11J and thin-film transistors (TFTs) 11Q are arranged. A gate insulating layer 11K which covers the compensating capacitance electrodes 11J is disposed on the inner surface of the transparent substrate 11B. Picture element electrodes 11F which are electrically coupled to the TFTs 11Q are arranged in matrix on the gate insulating layer 11K. Further, orientation layers 11G and 11H are disposed at the top of multilayer structure set forth above on the inner surfaces of the transparent substrates 11A and 11B, respectively. The orientation layers 11G and 11H are processed with an orientation treatment in order to initially orientate the molecules of the liquid crystal material 11C in a predetermined direction. In addition, spacers 11M are inserted in the gap between the transparent substrates 11A and 11B in order to maintain a certain distance of the gap which is filled with the liquid crystal material 11C. In FIG. 1, liquid crystal capacitors 11P represent the capacitance of the liquid crystal material 11C between the picture element electrodes 11F and the common electrodes 11E. Compensating capacitors 11R represent the capacitance of the gate insulating layer 11K between the compensating capacitance electrodes 11J and the picture element electrodes 11K. Furthermore, in FIG. 2, polarizers 11S and 11V are disposed on the outer surfaces of the transparent substrates 11A and 11B, respectively. At the outside of the polarizer 11V, an optical diffuse plate 11T is disposed. Light source 11U is disposed adjacent to the optical diffuse plate 11T.

The TFT 11Q comprises a semiconductor layer formed by an amorphous silicon or poly-silicon material disposed on the outer surface of the gate insulating layer 11K to cover the gate electrode, and a gate electrode, a source electrode and a drain electrode which are respectively coupled with both sides of the semiconductor layer. The TFT 11Q provides electric potential on the drain line 18 to the picture element electrode 11F when the source electrode and the drain electrode are conducted by gate voltage Vg provided from the gate driver circuit 12 to the gate electrode of the TFT 11Q through the gate line 17.

The gate driver circuit 12 sequentially selects one of the gate lines 17 in the manner of the line-sequential scanning under the control of the control circuit 14 in order to turn on the TFTs which are connected to the selected gate line 17. That is, the gate driver circuit 12 provides the gate voltage Vg to one of the gate lines 17 in sequence according to gate control signals Scg provided from the control circuit 14. In this manner, the gate voltage Vg is provided to each of the gate electrodes of the TFTs 11Q through the gate line 17 to turn on the TFTs.

Figure 3:
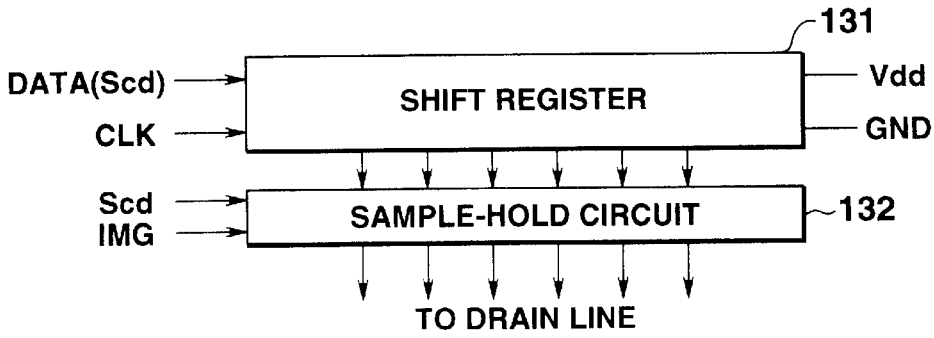
FIG. 3 is a block diagram of a drain driver circuit of the liquid crystal display apparatus shown in FIG. 1.
Figure 4:
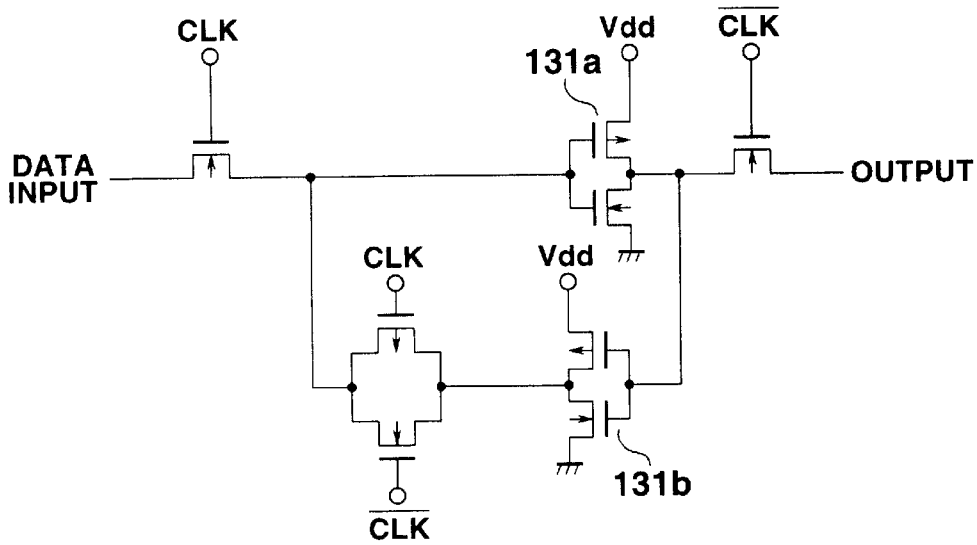
FIG. 4 is a circuit diagram of a shift register of the drain driver circuit shown in FIG. 3.
Figure 5:
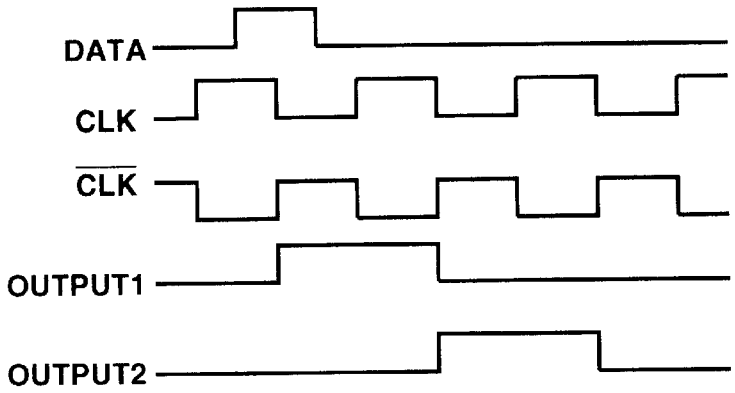
FIG. 5 is a time chart illustrating signals produced by the shift register shown in FIG. 4.

The drain driver circuit 13 comprises a shift register 131 and a sample-hold circuit 132, as shown in FIG. 3. The shift register 131 is electrically coupled to terminals Vdd and GND of a power source (not shown) and is supplied with a start signal DATA included in drain control signals Scd and a clock signal CLK from the control circuit 14. FIG. 4 shows a circuit of each stage of the shift register 131. Each stage of the shift register 131 comprises invertors 131*a* and 131*b* which include a plurality of complementary metal oxide semiconductor (CMOS) transistors. Further, each stage of the shift register 131 is provided the clock signal CLK from the control circuit 14 and an inverted clock signal $\overline{\text{CLK}}$ produced by inverting the clock signal CLK. In a first stage of the shift register 131, the start signal DATA is supplied from the control circuit 14 to an input terminal DATAINPUT. In other stages of the shift register 131, an output signal OUTPUT is supplied from the previous stage to the input terminal DATAINPUT. Each stage of the shift register 131 outputs an output signal OUTPUT to the sample-hold circuit 132 and the subsequent stage in response to the signal supplied to the input signal DATAINPUT, corresponding to the clock signal CLK and the inverted clock signal CLK. For example, in FIG. 5, the first stage of the shift register 131 outputs an output signal OUTPUT1 to the sample-hold circuit 132 and the second stage in response to the start signal DATA, and the second stage outputs an output signal OUTPUT2 to the sample-hold circuit 132 and the third stage in response to the output signal OUTPUT1 from the fist stage.

The sample-hold circuit 132 is supplied the output signals OUTPUT from the shift register 131 and image signals IMG and the drain control signals Scd from the control circuit 14. The sample-hold circuit 132 includes conventional data input and a data output buffers (not shown) and is coupled to the drain lines 18 of the display panel 11 by way of the display signal cutting switches 22. The sample-hold circuit 132 temporarily stores the image data IMG of one line of one frame based on the drain control signals Scd from the control circuit 14 and the output signals OUTPUT from the shift register 131. The circuit 132 outputs the stored image data to the drain lines 18 based on the drain control signals Scd from the control circuit 14 as display signals.

The sample-hold circuit 132 has a plurality of buffer areas (not shown) corresponding to each stage of the shift register 131 in both buffers. Further, the sample-hold circuit 132 includes switches (not shown) for inputting and outputting data, capacitors (not shown) for temporarily storing data, amplifiers (not shown) for amplifying voltage of the data output from the capacitors. Since the sample-hold circuit 132 does not have any CMOS transistors, it consumes only small electric power.

The control circuit 14 is supplied a video signal Svd from an external circuit (not shown). The control circuit 14 produces the clock signal CLK, gate control signals Scg to control the gate driver circuit 12 and the drain control signals Scd to control the drain driver circuit 13 based on the horizontal and vertical synchronizing pulses of the video signal Svd. Further, the control circuit 14 produces the image signal IMG which is extracted from the video signal Cvd. The control circuit 14 inverted polarities of the image signal IMG included in every second frame of the video signal Cvd and outputs the image signal IMG to the drain driver circuit 13. The control circuit 14 also produces a reading signal Srd which is output to the reading switches 23 though a reading signal line 32, a writing signal Swr which is output to the re-writing switches 25 through a writing signal line 33, and a reverse signal Srv which is output to the level modulator circuits 24 through a reverse signal line 34, based on the horizontal and the vertical synchronizing pulses. Furthermore, the control circuit 14 determines whether or not the image signals IMG included in predetermined numbers of frames are coincident with one frame by one, in order to discriminate between a sill image and a motion image which are represented by the video signal Svd. When the control circuit 14 finds that the image signals IMG of predetermined numbers of the frames are coincident, that is, when the video signal Svd represents a still image, the control circuit 14 outputs a drain driver off signal Sdo to the display signal cutting switches 22 through a driver off signal line 31 after the image signals IMG of one frame are completely output to the drain driver circuit 13. The driver off signal Sdo is also supplied to AND gate 21, which ceases supplying the clock signal CLK to the drain driver circuit 13 when the driver off signal Sdo is at a low level.

The display signal cutting switches 22 connect to the drain lines 18 of the display panel 11 and the drain driver circuit 13 at their source terminal and drain terminal. The cutting switches 22 stop supplying the display signals corresponding to the image signal IMG from the drain driver circuit 13 to the picture element electrodes 11F of the display panel 11 when the driver off signal Sdo is at a low level.

The reading switch 22 connects to the level modulator circuit 24 and the drain line 18 at their source terminal and drain terminal. The reading switch 22 allows the supply of the picture element voltage Vp, which is electric potential on the picture element electrode 11F coupled to the gate line 17 selected by the gate driver circuit 12, to the level modulator circuit 24 when the reading signal Srd output form the control circuit 14 is at a high level.

Figure 6:
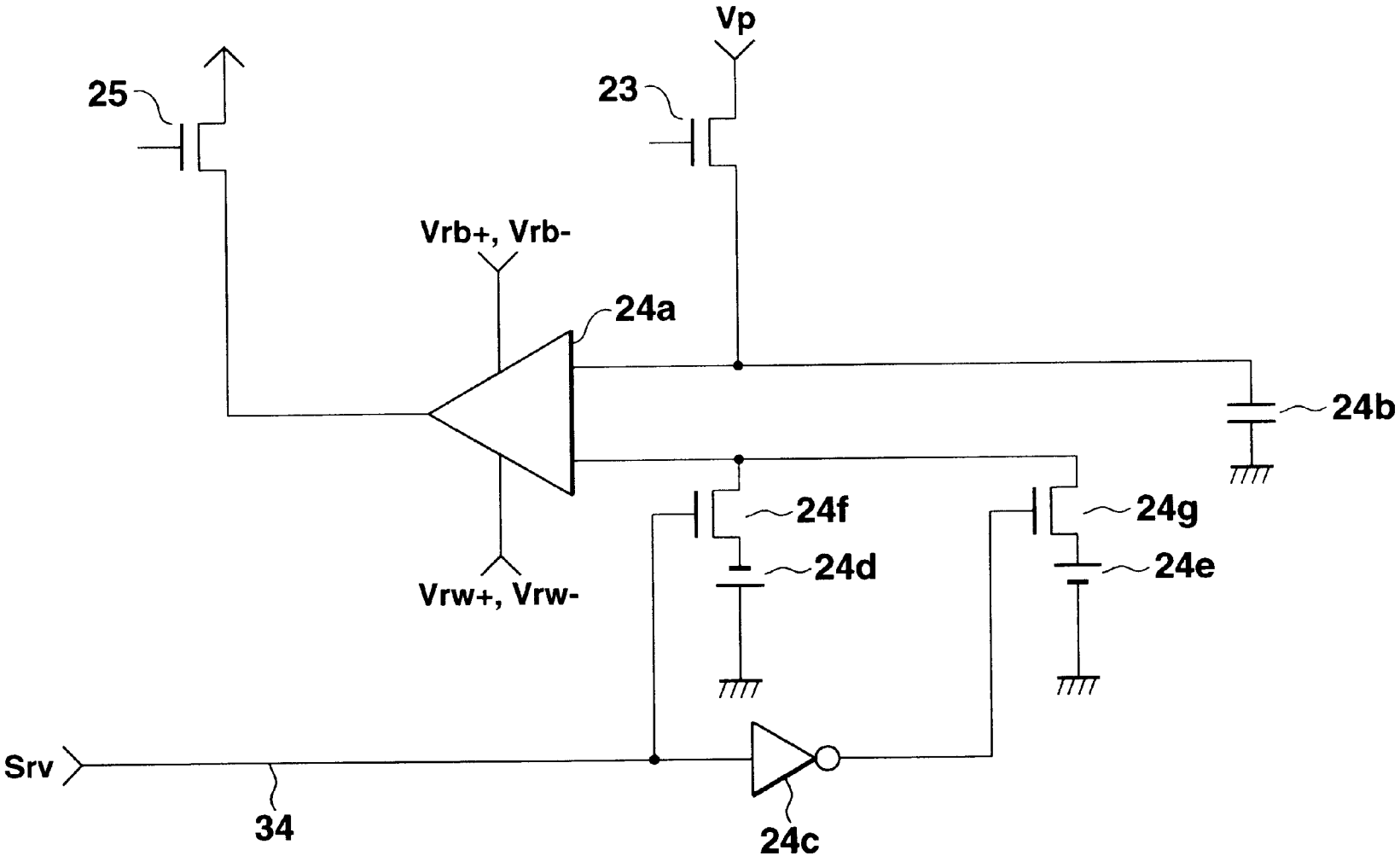
FIG. 6 is a circuit diagram showing a level modulator circuit of the liquid crystal display apparatus shown in FIG. 1.

FIG. 6 shows a circuit of the level modulator circuit 24. The level modulator circuit 24 comprises a comparator 24*a*, a capacitor 24*b*, an invertor 24*c*, reference voltage sources 24*d* and 24*e* and gate switches 24*f* and 24*g*. The capacitor 24*b* receives the picture element voltage Vp charged in the liquid crystal capacitor lip through the TFT 11Q, the drain line 18 and the reading switch 23, and stores this voltage Vp. The reference voltage source 24*e* supplies a first reference voltage Vref1 to the comparator 24*a* through the gate switch 24*g*. The reference voltage source 24*d* supplies a second reference voltage Vref2 to the comparator 24*a* through the gate switch 24*f*.

Figure 7:
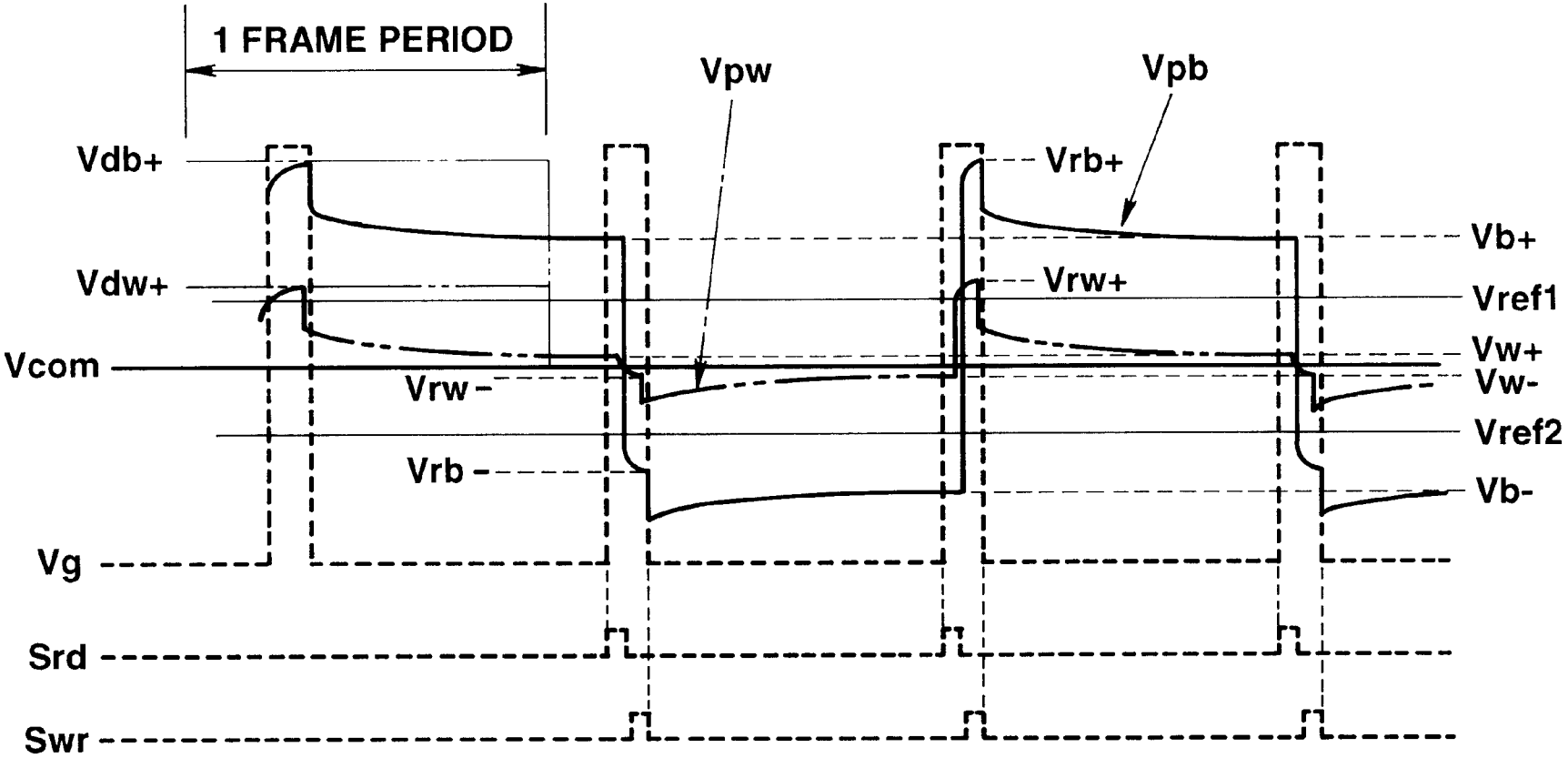
FIG. 7 is a time chart illustrating signals providing to the liquid crystal display panel and control signals output from a control circuit of the liquid crystal display apparatus shown in FIG. 1.

FIG. 7 shows relation between the reference voltages Vref1 and Vref2 and the picture element voltage Vp. In FIG. 7, a two-dotted line denoted by Vpw represents the actual picture element voltage charged in the liquid crystal capacitor 11P for displaying white, which corresponds to the electric potential on the picture element electrode 11E, and a two-dotted chain line denoted by Vpb represents actual picture element voltage charged in the liquid crystal capacitor 11P for displaying black. Levels denoted by Vw+ and Vw− represent picture element voltages at the time when the picture element voltage Vpw for displaying white has been attenuated during a period of displaying to image data IMG of one frame. Levels denoted by Vb+ and Vb− represent picture element voltages at the time when the picture element voltage Vpw for displaying black has been attenuated during a period of displaying to image data IMG of one frame. A line denoted by Vcom represents voltage which is provided to the common electrode 11E. Two-dotted chain lines denoted by Vdw+ and Vdb+ represent output voltages for displaying white and black, which are output from the drain driver circuit 13 to the drain lines 18 respectively. A dotted line denoted by Vg represents output voltage output from the gate driver circuit 12 to the gate lines 17. As shown in FIG. 7, the first reference voltage Vref1 is set at a level between the levels Vw+ and Vb+ and the second reference voltage Vref2 is set the level between the levels Vw− and Vb−.

The switches 24*f* and 24*g* are provided with the reverse signal Srv and an inverted reverse signal which is inverted by the invertor 24*c* respectively, to selectively permit the supply of either the first reference voltage Vref1 or the second reference voltage Vref2 to the comparator 24*a*.

The comparator 24*a* compares the picture element voltage Vp charged in the capacitor 24*b* with the first or second reference voltage, Vref1 or Vref2 in order to determine whether the picture element voltage Vp charged in the capacitor 24*b* is for displaying white or black, and then selectively outputs one of re-writing voltages Vrw+, Vrw−, Vrb+ and Vrb−, which have an opposite polarity to the element voltage Vp charged in the capacitor 24*b*, and one of picture element voltages for displaying white and black in response to the comparison.

The re-writing voltages Vrb+, Vrb−, Vrw+ and Vrw− are set at an appropriate picture element voltage to display the image on the display panel 11. The rewriting voltages Vrb+, Vrb−, Vrw+ and Vrw− may be set at the same voltages with the voltages Vdb+, and Vdw+ shown in FIG. 7 and their negative voltages Vdb− and Vdw− (not shown) which are provided from the drain driver circuit 13 to the drain lines 18. In this case, a voltage source (not shown) which provides the voltage Vdb+, Vdb−, Vbw+ and Vdw− to the drain driver circuit 13 may be also used in the level modulator circuit 24 in order to obtain the re-writing voltages Vrb+, Vrb−, Vrw+ and Vrw−.

The re-writing switch 25 connects to the level modulator circuit 24 and the drain line 18 at their source terminal and drain terminals. The re-writing switch 25 allows to be provided the re-writing voltage from the comparator 24*a* to the picture element electrode 11F through the drain line 18 when the re-writing signal Swr is at a high level.

The operation of the display apparatus set forth above will now be described.

First, the operation for displaying the motive image will be described. When the control circuit 14 determines that the video signal Svd represents the motion image, the control circuit 14 outputs a high level of the drain driver off signal Sdo. Therefore, the clock signal CLK is supplied from the control circuit 14 to the drain driver circuit 13 through the AND gate 21, and the display signal cutting switches 22 is made an on-state. On the other hand, the control circuit 14 outputs a low level of the reading signal Srd and a low level of the writing signal Swr. Therefore, both the reading switches 23 and the re-writing switches 25 are made an off-state.

In the drain driver circuit 13, the shift register 131 starts the operation in response to the start signal DATA including the drain control signals Scd supplied from the control circuit 14. The shift register 131 sequentially outputs the output signals OUTPUT from each stage in accordance with the clock signal CLK. The sample-hold circuit 132 temporarily stores the image signal IMG output from the control circuit 14 in sequence, based on the output signals OUTPUT of the shift register 131.

The gate driver circuit 12 selects one of the gate lines 17 and provides the gate voltage Vg to the selected the gate line 17 based on the gate control signals Scg output from the control circuit 14. The TFTs 11Q connected to the selected gate line 17 are turned on by the gate voltage Vg provided from the gate driver circuit 12. The image signal IMG of one line of one frame stored in the sample-hold circuit 132 is amplified to a predetermined level and then provided to the drain line 18 based on the drain control signals Scd. Therefore, the picture element electrodes 11F connected the TFTs 11Q which are turned on are provided the picture element voltage Vp of display signals corresponding to the amplified image signal IMG through the drain lines 18. All of the picture element electrodes 11F are provided the picture element voltage Vp of the display signals corresponding to the image signals IMG of one frame by being selected all gate lines 17 by the gate driver circuit 12. As the control circuit 14 determines that the video signal Svc represents the motion image, the operation set forth above is repeatedly performed with respect to the image data IMG of every frame of the video signal Svd. The liquid crystal material 11C permits light of the light source 11V to or prevents the light of the light source 11V from passing through it according to the picture element voltage Vp charged in the liquid crystal capacitor 11P whereby the display panel 11 displays an image corresponding to the image signal IMG.

The operation for displaying the still image will be described. When the control circuit 14 determines that the video signal Svd represents the still image, the same operation as that for displaying the motion image is performed with respect to the first frame of the video signal Svd. Thereafter, the control circuit 14 outputs a low level of the drain driver off signal Sdo after the image signal IMG of one frame is completely supplied from the control circuit 14 to the drain driver circuit 13. Therefore, the drain driver circuit 13 is stoped since the clock signal CLK is not supplied from the AND gate 21 to the shift register 131. The image signal IMG is not supplied from the drain driver circuit 13 to the drain lines 18 since the picture element signal cutting switches 22 are turned off by the drain driver off signal Sdo. On the other hand, the gate driver circuit 12 continues to perform the same operation as that for displaying the motion image. In this situation, the display panel 11 is capable of displaying the still image since the liquid crystal capacitor lip maintains the picture element voltage Vp provided from the drain driver circuit 13 without another voltage Vp to be repeatedly provided from the drain driver circuit 13. At this moment, the shift register 131 does not consume any electric power because the shift register 131 does not act.

However, if a liquid crystal display panel continues to display the still image based on voltage charged in liquid crystal capacitance, the liquid crystal material would deteriorate because of the direct current supplied to it. On the other hand, the liquid crystal display panel is not able to display the still image based on the voltage stored in the liquid crystal capacitance for a long time because the voltage in the liquid crystal capacitance leaks out.

Therefore, the display apparatus performs a re-writing operation. That is, the level modulator circuit 24 operates in order to repeatedly provide the picture element voltage appropriate to the display operation of the display panel 11.

First, the control circuit 14 outputs high level of the reading signal Srd at the same time when the gate driver circuit 12 provides the gate voltage Vg to the selected gate line 17. At this moment, the writing signal Swr is still kept at a low level, whereby the re-writing switches 25 is still kept in an off-state. The picture element voltage Vp on the picture element electrode 11F which is connected to the TFT 11Q on the selected gate line 17, is provided to the capacitor 24*b* of the level modulator circuit 24 through the drain line 18 and the reading switch 23, and is charged in the capacitor 24*b*. The picture element voltage Vp charged in the capacitor 24*b* is provided to the comparator 24*a* and compared with one of the reference voltages Vref1 and Vref2 supplied from the reference voltage sources 24*e* and 24*d*. The control circuit 14 alternatively outputs either a high or low level of the reverse signal Srv during each frame display period. That is, during a frame period following a frame period in which the display panel 11 is driven by a positive level of the picture element voltage Vp with respect to the common voltage Vcom, the control circuit 14 outputs low level of the reverse signal Srv. Therefore, the first reference voltage Vref1 is supplied from the source 24*e* to the comparator 24*b* due to the switch 24*g* turns on by the inverted reverse signal Srv which is inverted the reverse signal Srv by invertor 24*c*. Conversely, during a frame period following a frame period in which the display panel 11 is driven by a negative level of the picture element voltage Vp with respect to the common voltage Vcom, the control circuit 14 outputs a high level of the reverse signal Srv. Therefore, the second reference voltage Vref2 is supplied from the source 24*d* to the comparator 24*b* due to the switch 24*f* turns on by the reverse signal Srv.

The comparator 24*a* compares the picture element voltage Vp charged in the capacitor 24*b* with one of the reference voltage Vref1 and Vref2, and outputs one of the re-writing voltages Vrb+, Vrb−, Vrw+ and Vrw− based on the result of the comparison. The re-writing voltages Vrb+, Vrb−, Vrw+ and Vrw− are set at an appropriate picture element voltage to display the image on the display panel 11. The re-writing voltages Vrb+, Vrb−, Vrw+ and Vrw− may be set at the same voltages with the voltages Vdb+, and Vdw+ shown in FIG. 7 and their negative voltages Vdb− and Vdw− (not shown) which are provided from the drain driver circuit 13 to the drain lines 18.

The operation of the comparator 24*a* will now be described in detail. During a frame period following a frame period in which the display panel 11 is driven by a positive level of the picture element voltage Vp with respect to the common voltage Vcom, the capacitor 24*b* is charged the picture element voltage Vpb for displaying black or Vpw for displaying white with a positive level. At this moment, the control circuit 14 outputs a low level of the reverse signal Srv, whereby the comparator 24*a* is supplied the first reference voltage Vref1 from the first reference voltage source 24*e* through the switch 24*g*. If the picture element voltage Vp charged in the capacitor 24*b* is higher than the first reference voltage Vref1, the comparator 24*a* determines that the voltage Vp charged in the capacitor 24*b* is the voltage Vpb for displaying black, and outputs the appropriate re-writing voltage Vb− for displaying black with a negative level. Conversely, if the picture element voltage Vp charged in the capacitor 24*b* is lower than the first reference voltage Vref1, the comparator 24*a* determines that the voltage Vp charged in the capacitor 24*b* is the voltage Vpw for displaying white, and outputs the appropriate re-writing voltage Vw− for displaying white with a negative level. Regarding a frame period in which the display panel 11 is driven by a positive level of the picture element voltage Vp with respect to the common voltage Vcom, the capacitor 24*b* is charged the picture element voltage Vpb for displaying black or Vpw for displaying white with a negative level. At this moment, the control circuit 14 outputs a high level of the reverse signal Srv, whereby the comparator 24*a* is supplied the second reference voltage Vref2 from the second reference voltage source 24*d* through the switch 24*f*. If the picture element voltage Vp charged in the capacitor 24*b* is lower than the second reference voltage Vref2, the comparator 24*a* determines that the voltage Vp charged in the capacitor 24*b* is the voltage Vpb for displaying black, and outputs the appropriate re-writing voltage Vb+ for displaying black with positive level. Conversely, if the picture element voltage Vp charged in the capacitor 24*b* is higher than the second reference voltage Vref1, the comparator 24*a* determines that the voltage Vp charged in the capacitor 24*b* is the voltage Vpw for displaying white, and outputs the re-writing voltage Vw+ which has an appropriate voltage for displaying white with a positive level.

During the latter half period of the period in which the gate driver circuit 12 supplies the gate voltage Vg to the gate line 17, the control circuit 14 outputs a high level of the writing signal Swr and a low level of the reading signal Srd. Therefore, the rewriting switches 25 are turned on and the reading switches 23 are turned off. The re-writing voltage Vrb+, Vrb−, Vrw+ or Vrw− output from the comparator 24*a* is provided to the picture element electrode 11F. In the operation set forth above, the display panel 11 displays the still image based on the picture element voltage Vp the polarity of which is inverted in each frame.

The level modulator circuits 24 consume approximately same amount of the electric power as that consumed by the sample-hold circuit 132 of the drain driver circuit 13. Therefore, this display apparatus can save the electric power which otherwise would be consumed by the shift register 131 when the apparatus displays the still image.

The re-writing operation set forth above is performed with respect to all picture element electrodes 11F in response to the gate line 17 selected by the gate driver 12. Further, the re-writing operation is repeatedly performed with respect to each frame as long as the control circuit 14 determines that the video signal Svr represents the still image. Further, when the control circuit 14 determines that the video signal Svr represents the motive image during the re-writing operation, the control circuit 14 stops the re-writing operation and starts the motive image display operation set forth above with respect to the video signal Svr representing the motive image.

Second Embodiment

This embodiment is an LCD apparatus which capable of displaying data in multi-graduated monochrome.

Figure 8:
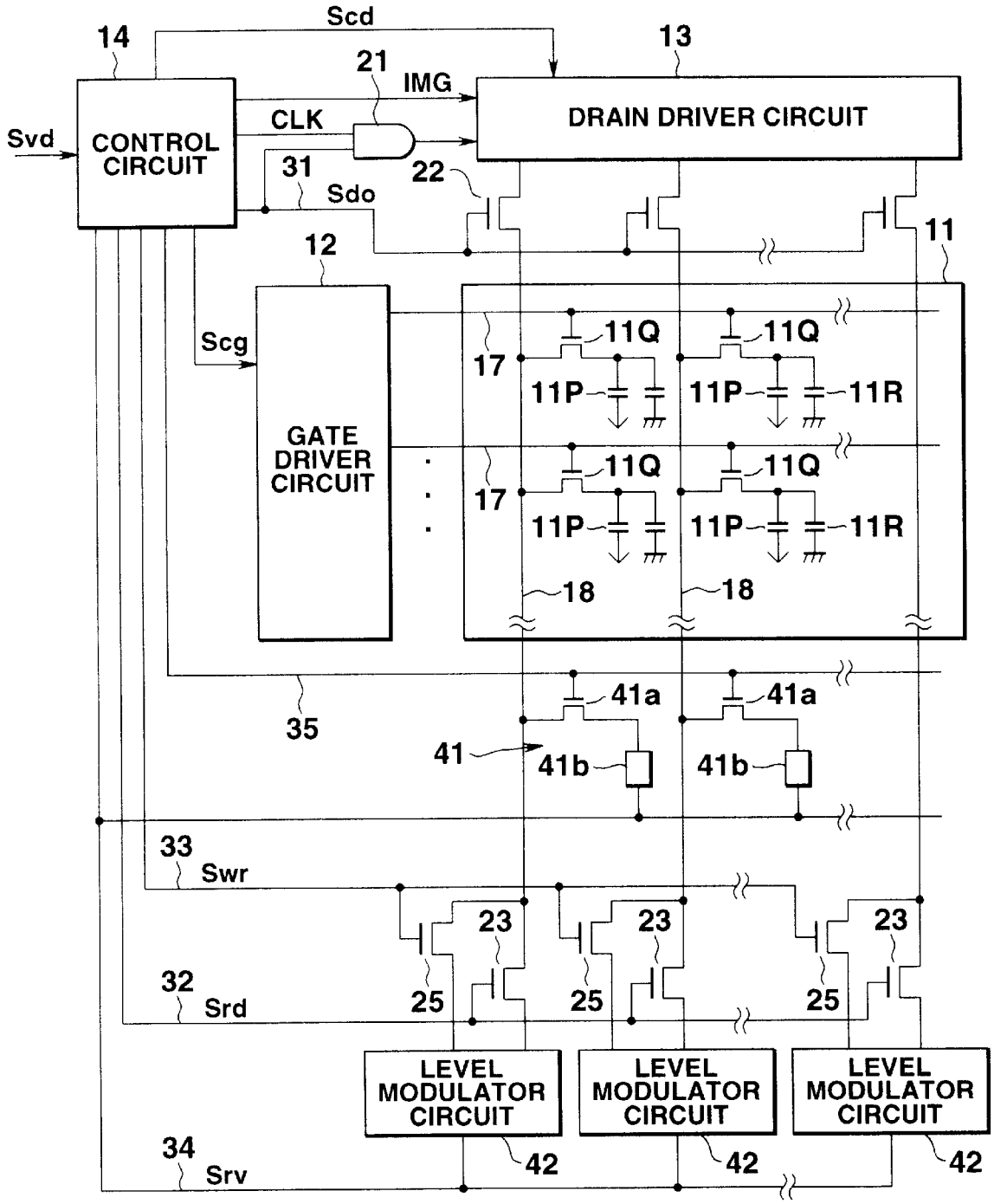
FIG. 8 is a block diagram showing a liquid crystal display apparatus in a second embodiment of the present invention.

FIG. 8 shows a schematic representation of the LCD apparatus of the second embodiment. The LCD apparatus shown in FIG. 8 is the same structure with that of the LCD apparatus shown in FIG. 1 except for reset circuits 41 and level modulator circuits 42.

The reset circuit 41 comprises a switch 41*a* and a reset voltage source 41*b*. The switch 41*a* connects to the control circuit 14 and is supplied with a reset signal from the control circuit 14 through the reset signal line 35. The reset voltage source 41*b* connects to the drain line 18 by way of the switch 41*a* and the control circuit 14 and provides a reset voltage +Vrs or Vrs to the drain line 18 through the switch 41*a* in response to the reverse signal Srv supplied from the control circuit 14. That is, the reset circuit 41 supplies the positive reset voltage +Vrs to the drain line 18 during a frame period following a frame period in which the display panel 11 is driven by the positive level of the picture element voltage Vp. On the other hand, the reset circuit 41 supplies the negative reset voltage −Vrs to the drain line 18 during a frame period following a frame period in which the display panel 11 is driven by the negative level of the picture element voltage Vp. The control circuit 14 outputs a high level of the reset signal to the reset signal line 35 during the period when the gate driver circuit 12 does not provide the gate voltage Vg to any gate lines 17. Therefore, the reset circuit 41 refreshes residual potential on the drain line 18 by supplying the reset voltage +Vrs or −Vrs to the drain lines 18. In this embodiment, when the gate driver circuit 12 outputs the gate voltage Vg during a period of displaying the still image, the picture element voltage Vp charged in the picture element electrode 11F adds to the reset voltage Vrs on the drain line 18. Therefore, the voltage (Vp+Vrs) is supplied to the level modulator circuit 42 through the drain line 18.

Figure 9:
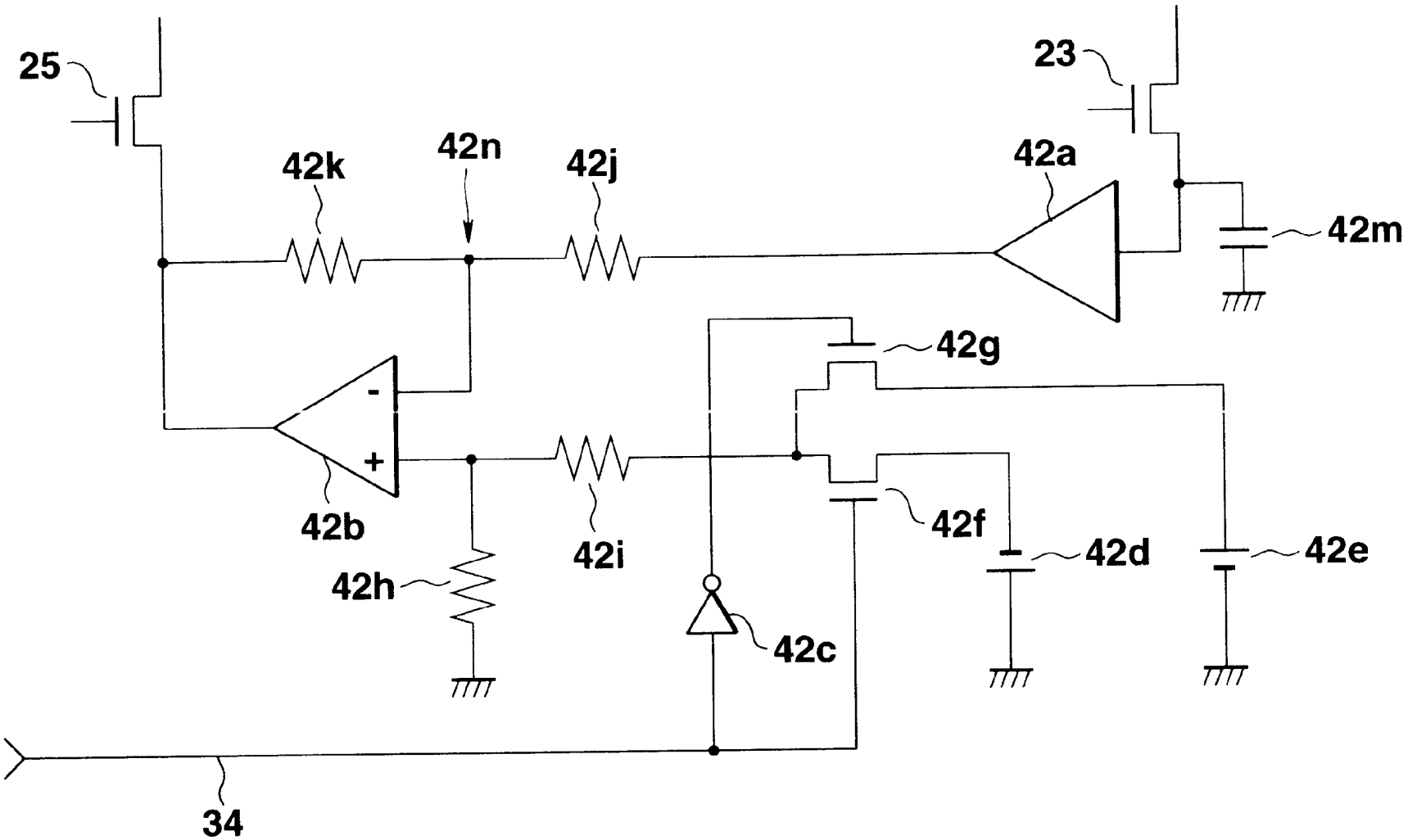
FIG. 9 is a block diagram of a drain driver circuit of the liquid crystal display apparatus shown in FIG. 1.

FIG. 9 shows the level modulator circuit 42, which includes an amplifier 42*a*, an operational amplifier 42*b*, an invertor 42*c*, reference voltage sources 42*d* and 42*e*, gate switches 42*f*, 42*g* and capacitor 42*m* and resistors 42*h*, 42*i*, 42*j* and 42*k*. The capacitor 42*m* connects to the reading switch 23 and is charged with the voltage (Vp+Vrs) provided from the drain line 18 through the reading switch 23. The capacitor 42*m* also connects to the amplifier 42*a* and provides with the voltage (Vp+Vrs) to the amplifier 42*a*. The amplifier 42*a* is amplified the voltage (Vp+Vrs) in order to add attenuated voltage Vdp which is leaked out from the picture element electrode 11F during a one frame display period and dropped voltage Vcm which is dropped by a parasitic capacitance of the TFT. The amplifier 42*a* provides the amplified voltage (Vp+Vrs+Vdp+Vcm) to a minus input terminal of the operational amplifier 42*b* by way of the resistor 42*j*. The minus input terminal of the operational amplifier 42*b* is also provided a feedback voltage from the output terminal of the operational amplifier 42*b* by way of the resister 42*k*. The plus input terminal of the operational amplifier 42*b* is provided the reference voltage sources 42*d* and 42*g* through the switches 42*g* and 42*f* and the resistor 42*i*. The switches 42*f* and 42*j* select one of the reference voltage source 42*d* and 42*e* according to the reverse signal Srs output from the control circuit 14 in order to provide one of the reference voltages to the subtracting circuit 42*n*. That is, during a frame period following a frame period in which the display panel 11 is driven by a positive level of the picture element voltage Vp, the positive level of the reference voltage of the reference voltage source 42*d* is provided to the plus input terminal of the operational amplifier 42*b*. Conversely, during a frame period following a frame period in which the display panel 11 is driven by a negative level of the picture element voltage Vp, the negative level of the reference voltage of the reference voltage source 42*d* is provided to the plus input terminal of the operational amplifier 42*b*. The reference voltages Vref of the reference voltage sources 42*g* and 42*f* are adjusted to the appropriate voltages by the resisters 42*i* and 42*h*. The operational amplifier 42*b* generates an output voltage corresponding to the difference between the voltages on the plus input terminal and the minus input terminal. That is, the output voltage of the operational amplifier 42*b* is adjusted based on relation between the feedback voltage provided and the output voltage of the amplifier 42*a* which are provided to the minus input terminal through the resistors 42*k* and 42*j* respectively, and the reference voltage Vref provided to the plus input terminal through the resistor 42*i*. The operational amplifier 42*b* also generates a negative output voltage when the voltage provided to the minus input terminal is larger than the voltage provided to the plus input terminal. Conversely, The operational amplifier 42*b* also generates the positive output voltage when the voltage provided to the minus input terminal is smaller than the voltage provided to the plus input terminal. Therefore, the operational amplifier 42*b* adjusts its output voltage to re-writing voltage (Vp+Vdp+Vcm) with opposite polarity to that of the voltage provided to the minus input terminal. The operational amplifier 42*b* and the resisters 42*h*, 42*i*, 42*j* and 42*k* set forth above constitute the subtracting circuit 42*n*.

The operation of the LCD apparatus of the second embodiment will now be described. When the LCD apparatus displays of the second embodiment the motion image, the LCD apparatus performs the same operation as that of the LCD apparatus of the first embodiment.

When the LCD apparatus displays the still image, the same operation with that for displaying the motion image is performed with respect to the first one frame of the video signal Svd. Thereafter, the control circuit 14 outputs a low level of the drain driver off signal after the display signal corresponding to the drain driver circuit 13 completely supplies the image signal IMG to the picture element electrodes 11E, and then starts controlling a re-writing operation. The control circuit 14 also outputs a high level of the reset signal 35 while the gate drive circuit 12 does not provide the gate voltage Vg to any gate lines 17. Further, the control circuit 14 outputs the reverse signal Srs to the reset circuit 41 depending on the level of the picture element voltage Vp by which the display panel 11 is driven. The reset voltage source 41*b* provides one of the reset voltages +Vrs and −Vrs corresponding to the reverse signal to the drain line 18 in order to refresh the residual potential on the drain line 18. Thereafter, the control circuit 14 outputs a low level of the reset signal to the signal line 35 and a high level of the reading signal Srd at the same time when the gate driver circuit 12 selects one of the gate lines 17. The picture element voltage Vp charged in the LC capacitor 11P coupled to the selected gate line 17 is added to the reset voltage Vrs on the drain line 18. As a result, the voltage of the drain line 18 becomes the voltage (Vp+Vrs) and is charged in the capacitor 42*m* in the level modulator circuit 42 through the reading switch 23. The voltage (Vp+Vrs) charged in the capacitor 42*m* is provided to the amplifier 42*a* which amplifies the voltage (Vp+Vrs). The amplifier 42*a* also adds the voltage (Vp+Vrs) to the attenuated voltage Vdp which has been leaked out from the picture element electrode 11E during a one frame display period and the dropped voltage which is dropped by the parasitic capacitance of the TFT 11Q and provides this voltage (Vp+Vrs+Vpd+Vcm) to the minus input terminal of the operational amplifier 42*b*. The plus input terminal of the operational amplifier 42*b* is provided with one of the reference voltages from the reference voltage source 42*d* and 42*e* in accordance with the reverse signal Srs. The operational amplifier 42*b* generates an output voltage corresponding to the difference between the voltages on the plus input terminal and the minus input terminal. The operational amplifier 42*b* also generates a negative output voltage when the voltage provided to the minus input terminal is larger than the voltage provided to the plus input terminal. Conversely, the operational amplifier 42*b* also generates the positive output voltage when the voltage provided to the minus input terminal is smaller than the voltage provided to the plus input terminal. Therefore, the output voltage of the operational amplifier 42*b* is finally adjusted to the re-writing voltage −(Vp+Vdp+Vcm) based on relation between the feedback voltage provided and the output voltage (Vp+Vrs+Vdp+Vcm) of the amplifier 42*a* which are provided to the minus input terminal through the resistors 42*k* and 42*j* respectively, and the reference voltage Vref provided to the plus input terminal through the resistor 42*i*.

During the later half period of the time that the gate driver circuit 12 supplies the gate voltage Vg to the gate line 17, the control circuit 14 makes a high level of the writing signal Swr and a low level of the reading signal Srd. Therefore, the re-writing switches 25 are turned on and the reading switches 23 are turned off. At this moment, the operational amplifier 42*b* provides the re-writing voltage −(Vp+Vdp) to the picture element electrode 11F through the re-writing switch 25.

The re-writing operation set forth above is performed with respect to all picture element electrodes 11F in response to the gate line 17 selected by the gate driver 12. Further, the re-writing operation is repeatedly performed with respect to each frame as long as the control circuit 14 determines that the video signal Svr represents the still image. Further, when the control circuit 14 determines that the video signal Svr represents the motive image during the re-writing operation, the control circuit 14 stops the re-writing operation and starts the motive image display operation set forth above with respect to the video signal Svr representing the motive image.

Third Embodiment

Figure 10:
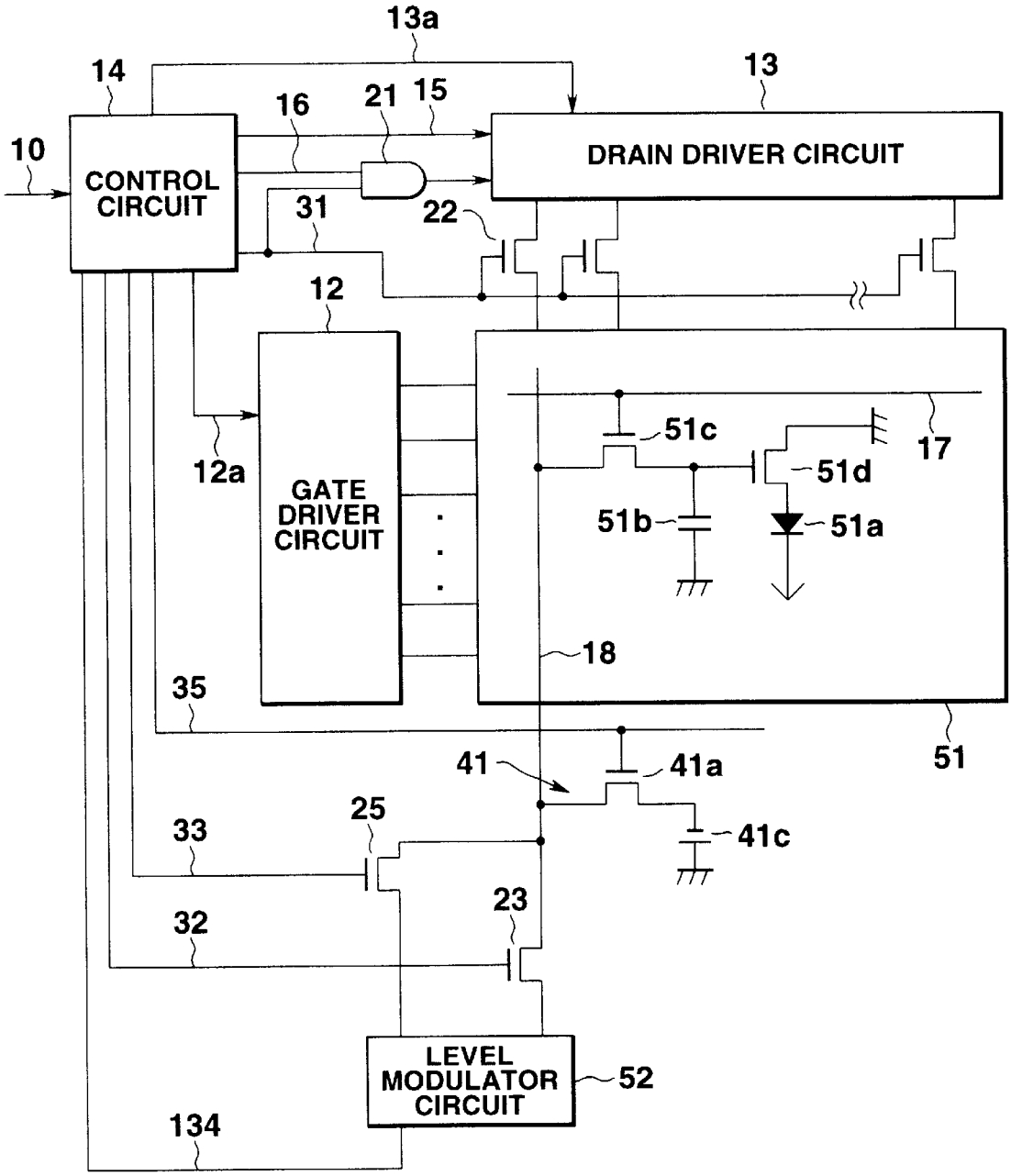
FIG. 10 is a block diagram showing an organic electroluminescent display apparatus in a third embodiment of the present invention.

This embodiment represents an organic electroluminescent (EL) display apparatus, and schematically represented in FIG. 10. The organic EL display apparatus has the same structure as that of the liquid crystal display apparatus of the second embodiment shown in FIG. 8 except for the addition of an EL display panel 51, a reset voltage source 41*c* and level modulator circuits 52.

The reset voltage source 41*c* provides one reset voltage to the drain line 18 through the reset switch 41*a* because the organic EL display apparatus is always driven with either a positive or negative level of display signals. Further, the control circuit 14 does not invert the polarity of the image data for the same reason.

Figure 11:
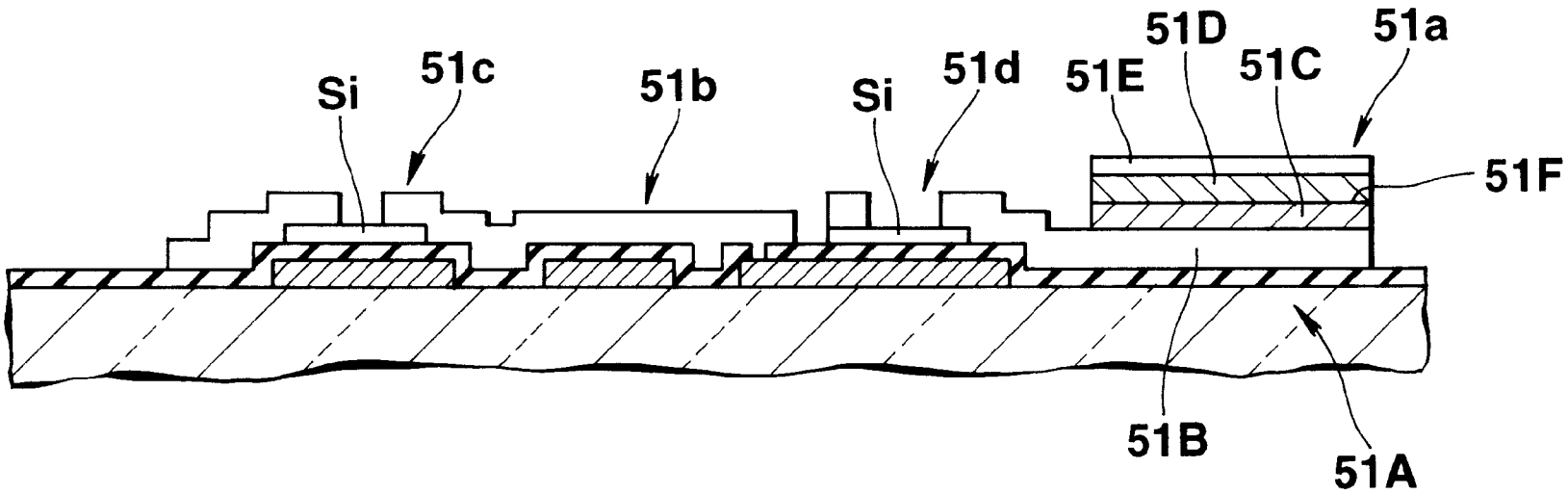
FIG. 11 is a section view of an organic electroluminescent panel of the organic electroluminescent display apparatus shown in FIG. 10.

FIG. 11 shows a structure of one picture element in the organic EL display panel 51. As shown in FIG. 11, the organic EL panel 51 comprises an organic EL element 51*a*, a data storing capacitor 51*b* and TFTs 51*c* and 51*d* disposed on a transparent substrate 51A. The organic EL element 51*a* comprises an anode electrode 51B disposed on the transparent substrate 51A, a hole transport layer 51C disposed on the anode electrode 51B, an electron transport layer 51D disposed on the hole transport layer 51C and a cathode electrode 51E disposed on the electron transport layer 51D. A P-N junction 51F is formed between the hole transport layer 51C and the electron transport layer 51D. The data storing capacitor 51*b* couples to the drain line 18 via the TFT 51*c* which connects to the gate line 17.

During the display operation, when the gate line 17 is selected by the gate driver circuit 12, the display signal with the picture element voltage Vp is supplied from the drain line 18 to the data storing capacitor 51*d* through the TFT 51*c* which is made on-stat by the gate signal on the selected gate line 17. The TFT 51*d* is turned on by voltage charged in the data storing capacitor 51*d* whereby direct current flows between the anode electrode 51B and the cathode electrode 51E. At this time, holes inject from the anode electrode 51B to the hole transport layer 51C, and electrons inject from the cathode electrode 51E to the hole transport layer 51C. Thereafter, the holes from the hole transport layer 51C and the electrons from the electron transport layer 51D inject to the P-N junction 51F. Visual light is emitted by coupling the holes to the electrons at the P-N junction 51F.

The organic EL display panel 51 is arranged with the picture element having the structure set forth above in matrix.

Figure 12:
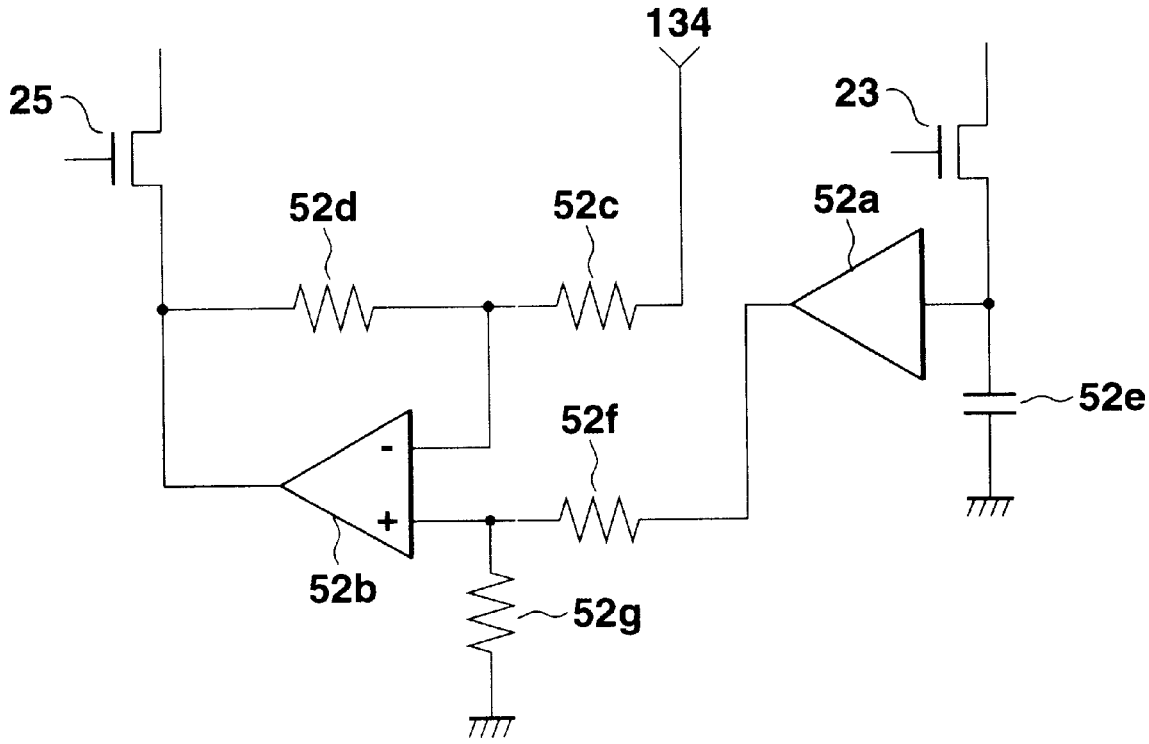
FIG. 12 is a block diagram of a drain driver circuit of the organic electroluminescent display apparatus shown in FIG. 10.

FIG. 12 shows the level modulator circuit 52. A capacitor 52*e* connects to the reading switch 23 and is provided with the picture element voltage Vp charged in the data storing capacitor 51*b* through the reading switch 23. The picture element voltage Vp charged in the capacitor 52*e* is provided to an amplifier 52*a*. The amplifier 52*a* is amplified with the voltage (Vp+Vrs) in order to add attenuated voltage Vdp which is leaked out from the picture element electrode 11F during a one frame display period and dropped voltage Vcm which is dropped by parasitic capacitance of the TFT 51*c*. The amplifier 52*a* provides the amplified voltage (Vp+Vrs+Vdp+Vcm) to a plus input terminal of the operational amplifier 52*b* by way of the resister 52*f*. The amplified voltage (Vp+Vrs+Vdp+Vcm) provided from the amplifier 52*a* is adjusted to the appropriate voltages by the resistors 52*f* and 52*g*. The minus input terminal of the operational amplifier 52*b* is provided with the reference voltage from the control circuit 14 by way of a resistor 52*c*. The minus input terminal of the operational amplifier 52*b* is also provided a feedback voltage from the output terminal of the operational amplifier 52*b* by way of a resistor 52*d*. The operational amplifier 52*b* generates the output voltage corresponding to the difference between the voltages on the plus input terminal and the minus input terminal. That is, the output voltage of the operational amplifier 52*b* is adjusted based on relation between the feedback and reference voltages which are provided to the minus input terminal through the resistors 52*d* and 52*c* respectively, and the amplified voltage provided to the plus input terminal through the resistor 52*f*. Therefore, the operational amplifier 52*b* adjusts its output voltage to re-writing voltage (Vp+Vdp).

The operation of the organic EL display apparatus will now be described. When the EL display apparatus displays the motion image, the EL display apparatus performs the same operation with that of the LCD apparatus of the second embodiment except for the inverting of the polarity of the image data by the control circuit 14. In the EL panel 51, the picture element voltage of the display signals are charged in the data storing capacitor 51*b* instead of the LC capacitor lip in the LC panel 11.

When the EL display apparatus displays the still image, the EL display apparatus performs the same operation as with that of the LCD apparatus of the second embodiment other than a re-writing operation. The control circuit 14 outputs a high level of the reset signal 35 to the reset switches 41*a* while the gate driver circuit 12 does not select any gate lines 17 after the display signals corresponding to the all image data IMG of one frame are completely provided from the drain driver circuit 13 to the EL panel 51. The rest voltage source 41*c* provides the reset voltage to the drain line 18 in order to refresh the residual potential on the drain line 18. Thereafter, the control circuit 14 outputs a low level of the reset signal to the signal line 35 and a high level of the reading signal Srd at the same time as the gate circuit 12 selects one of the gate lines 17 by providing the gate voltage Vg to one of the gate lines 17. The picture element voltage Vp charged in the data storing capacitors 51*b* coupled to the selected gate line 17 are added to the reset voltage Vrs charged on the drain lines 18. These are provided to the capacitor 52*e* in the level modulator circuit 52 through the reading switches 23. That is, the capacitor 52*e* is charged with the voltage (Vp+Vrs). This voltage (Vp+Vrs) charged in the capacitor 52*e* is provided to the amplifier 52*a* and is added to the voltage Vdp which has been leaked form the data storing capacitor 51*b* during display of data of one frame and dropped voltage Vcm which is dropped by parasitic capacitance of the TFT 51*c*. The amplified voltage (Vp+Vrs+Vdp+Vcm) is adjusted to the appropriate voltage by the resistors 52*f* and 52*g* and is provided to the plus input terminal of the operational amplifier 52*b*. On the other hand, the control circuit 14 provides the reference voltage Vref to the minus input terminal of the operational amplifier 52*b* through the signal line 134 and the resistor 52*c*. The operational amplifier 52*b* makes its output feedback to its minus input terminal through the resistor 52*d*. That is, the minus input terminal is provided with the voltage which is dropped the reference voltage Vref by the resistor 52*c* and the feedback voltage. The operational amplifier 52*b* generates the output voltage corresponding to the difference between the voltages on the plus input terminal and the minus input terminal. Finally, the output voltage of the operational amplifier 52*b* is adjusted to the re-writing voltage (Vp+Vdp+Vcm) by the feedback voltage provided to the minus input terminal through the resistor 52*d*.

In the meantime, the control circuit 14 outputs the high level of the writing signal Swr and low level of the reading signal Srd. Therefore, the re-writing voltage (Vp+Vdp) output from the operational amplifier 52*b* is provided to the data storing capacitor 51*b* through the re-writing switch 25 and drain line 18.

The re-writing operation set forth above is performed with respect to all picture element electrode 11F in response to the gate line 17 selected by the gate driver 12. Further, the re-writing operation is repeatedly performed with respect to each frame as long as the control circuit 14 determines that the video signal Svr represents the still image. Further, when the control circuit 14 determines that the video signal Svr represents the motive image during the re-writing operation, the control circuit 14 stops the re-writing operation and starts the motive image display operation set forth above with respect to the video signal Svr representing the motive image.

Fourth Embodiment

Figure 13:
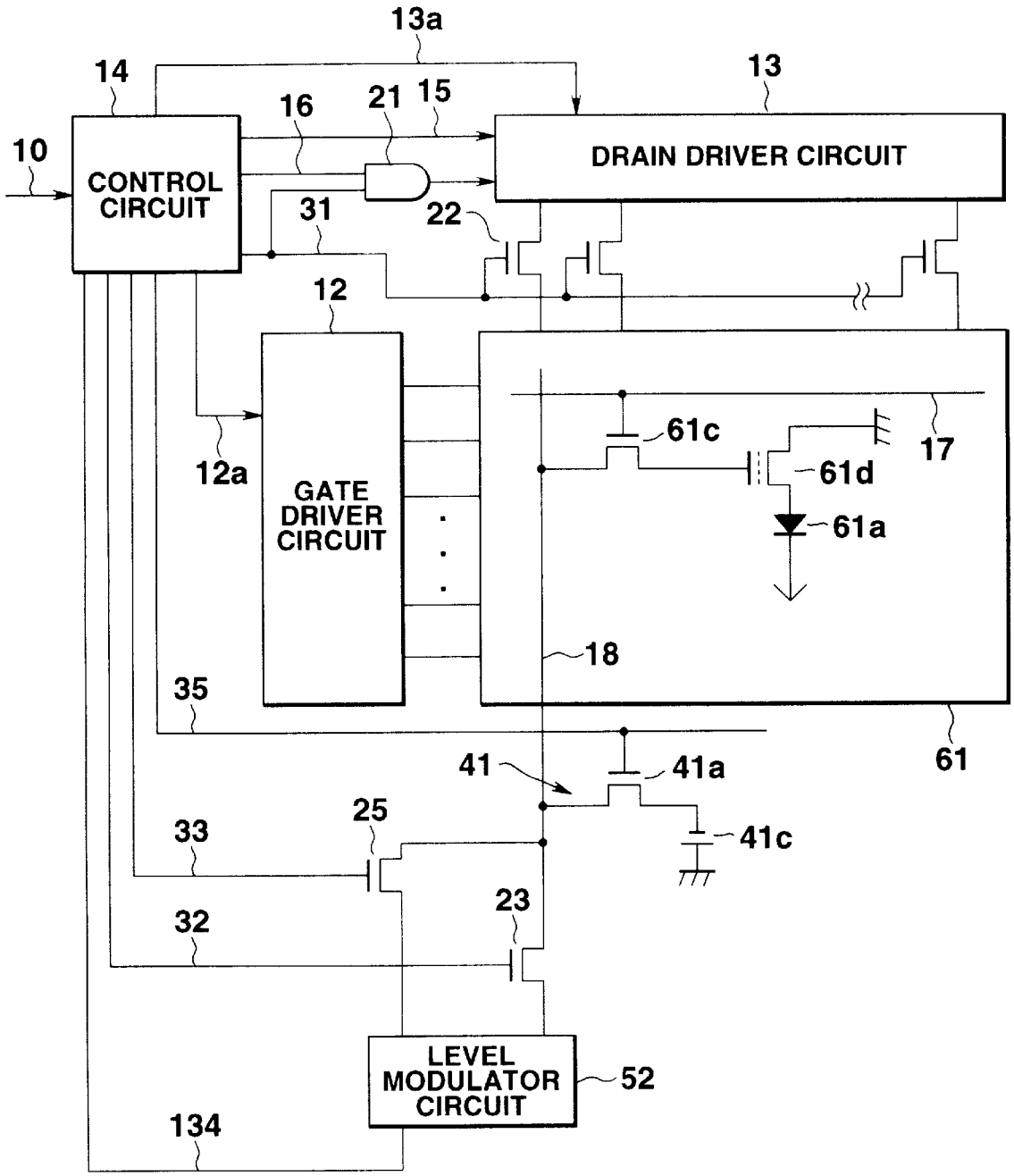
FIG. 13 is a block diagram showing an organic electroluminescent display apparatus of a fourth embodiment of the present invention.

FIG. 13 shows another organic EL display apparatus which uses a different type of the EL display panel 61 from that of the third embodiment. The EL display panel 61 includes an organic EL element 61*a*, TFT 61*c* and a memory TFT 61*d*. That is, the EL display panel 61 does not have a data storing capacitor. The memory TFT 61*d* has a gate insulating layer formed by silicon-rich material. Therefore, the TFT 61*d* is capable of maintaining the picture element voltage Vp which is provided from the drain driver 13 during the period in which the TFT 61*c* is turned off.

The picture element voltage Vp' charged in the TFT 61*d* is provided to the level modulator circuit 52 and the re-writing voltage (Vp+Vpd+Vcm) is provided from the level modulator circuit 52 to the TFT 61*d* while the still image is displayed.

Although the embodiments set forth above illustrate the invention as applied to LCD and organic EL display apparatuses, the invention may be used in various display apparatuses such as an inorganic EL display apparatus and LED display apparatus. Although the switching elements in the above illustrative embodiments are the TFTs, these may instead be diodes or metal insulator metal (MIM) transistors. Although the present LCD apparatus is a monochrome display apparatus, the present invention may be used in a color LCD display apparatus or electrically controlled birefringent (ECB) LCD display apparatus. Although the drain driver in the above illustrative embodiments is an analog driver, it may be a digital driver. Although the operation of the drain driver in the above illustrative embodiments is stoped by prevention from supplying the clock signal, it can also be stoped by preventing from supplying the power or by supplying a reset signal to the shift register. Although the level modulator circuit in the above illustrative embodiments performs its operation every period of displaying data for one frame display, it may perform its operation every period of displaying for plural frames. In this case, the gate driver circuit may also performs its scanning operation every period of displaying for plural frames. Also, the present invention is not limited to the level modulator which comprises a comparator or an operational amplifier as re-writing means; other suitable technologies may be used. For example, the re-writing voltage may be produced based on digital data which is converted from the picture element voltage read out from the display panel, using a look-up table and digital-to-analog converter.

What is claimed is:

1. A display apparatus which is supplied with display data, said display apparatus comprising:

a display panel having a plurality of picture elements which are arranged in a matrix having rows and columns;

signal processing means for producing image signals corresponding to the display data and for outputting the image signals;

scanning means for sequentially selecting each row of said display panel;

display signal supplying means for selecting each column of a next row in the sequence, producing display signals corresponding to the image signals for that row and supplying the display signals to the picture elements in that row in response to the scanning means;

determining means for determining whether the display data represents a still image;

control means for stopping the operation of said display signal supplying means including the selection of each column in the next row in the sequence after the display signals representing the still image are supplied to all picture elements unless and until said determining means determines that the display data no longer represents the same still image;

read-out means for reading out the display signals retained in the picture elements when said control means stops the operation of said display supplying means;

modulating means for modulating the display signals read out from the picture elements by said read-out means in order to obtain appropriate display signals to maintain displaying the still image on said display panel; and re-writing means for writing the modulated display signals into the picture elements from which the display signals were read out by said read-out means.

2. A display apparatus according to claim 1, wherein said modulating means comprises a plurality of modulating units, each of which is coupled to each column of said display panel, for modulating the display signal read out from the picture element in the coupled column.

3. A display apparatus according to claim 2, wherein said read-out means comprises means for simultaneously reading out the display signals retained in every picture element in one row of said display panel which is selected by said scanning means, and said re-writing means comprises means for simultaneously writing the modulated display signals into every picture element in the selected row.

4. A display apparatus according to claim 1, wherein said modulating means comprises amplifying means for amplifying the display signals read out from the picture elements by said read-out means.

5. A display apparatus according to claim 1, wherein said modulating means comprises detecting means for detecting the voltage of the display signal read out from the picture element by said read-out means, and means for determining an appropriate voltage based on the detected voltage and outputting a modulated display signal with the appropriate voltage.

6. A display apparatus according to claim 5, wherein said detecting means comprises comparator for comparing the voltage of the display signal read out from the picture element with a reference voltage.

7. A display apparatus according to claim 1, further comprising a signal line electrically coupled to the picture element and said read-out means for providing the display signal retained in the picture element to said modulating means through said read-out means; and a reset circuit for providing said signal line with a reset voltage to eliminate residual potential on said signal line before the display signal retained in the picture element is supplied to said modulating means through said read-out means.

8. A display apparatus according to claim 1, wherein said display signal supplying means comprises a shift register for selecting each column of the next row in the sequence, and said control means comprises means for controlling a clock signal into the shift register wherein the shift register operates when it receives the clock signal and stops operation when it does not receive the clock signal.

9. A display apparatus according to claim 8, wherein said data signal supplying means further comprises storing means for temporarily storing the display signals for the picture elements in one row.

10. A display apparatus according to claim 1, wherein said display panel comprises a liquid crystal display panel.

11. A display apparatus according to claim 10, wherein said modulating means comprises amplifying means for amplifying the display signals read out by said read-out means, and inverting means for inverting the polarity of the display signals.

12. A display apparatus according to claim 11, wherein said liquid crystal display panel comprises a switching element for connecting the picture element to either said display signal supplying means or said read-out means and the rewriting means, and said amplifying means comprises means for amplifying read-out display signals to compensate for a voltage drop caused by parasitic capacitance of said switching element.

13. A display apparatus according to claim 10, wherein said modulating means comprises detecting means for detecting the voltage of the display signal read out from the picture element, and means for determining an appropriate voltage based on the detected voltage and having an opposite polarity to the detected voltage, and outputting a modulated display signal with the determined voltage.

14. A display apparatus according to claim 13, wherein said detecting means comprises a comparator for comparing the voltage of the display signal read out from the picture element with a reference voltage.

15. A display apparatus according to claim 1, wherein said display panel comprises an organic electroluminescent display panel.

16. A display apparatus according to claim 15, wherein said modulating means comprises amplifying means for amplifying the display signals read out from the picture elements by said read-out means.

17. A display apparatus according to claim 16, wherein said organic electroluminescent display panel comprises a switching element for connecting said picture element to either said display signal supplying means or said read-out means and the rewriting means, and said amplifying means comprises means for amplifying read-out display signals to compensate for a voltage drop caused by a parasitic capacitance of said switching element.

18. A display apparatus according to claim 15, wherein said organic electroluminescent display panel comprises a data storing capacitor for storing the display singal.

19. A display apparatus according to claim 15, wherein said organic electroluminescent display panel comprises a thin film transistor for storing the display signal.

20. A method for driving a display apparatus which is supplied with display data and comprises a display panel having a plurality of picture elements which are arranged in a matrix having rows and columns, the method comprising the steps of:

producing image signals corresponding to the display data and outputting the image signals;

selecting each row of said display panel;

selecting each column of a next row in the sequence, producing display signals corresponding to the image signals for that row and supplying the display signals to the picture elements in that row;

determining whether the display data represents a still image;

stopping the selection of each column and production and supply of display signals after the display signals representing the still image are supplied to all picture elements unless and until the display data no longer represents the same still image;

reading out the display signals retained in the picture elements when the selection of each column and production and supply of display signals are stopped;

modulating the read out display signals in order to obtain appropriate display signals to maintain the still image displayed by said display panel; and re-writing the modulated display signals into the picture elements from which the display signals were read out.

21. The method of claim 20, wherein the step of modulating the read out display signals comprises amplifying the read out display signals.

22. The method of claim 20, wherein the step of modulating the read out display signals comprises detecting for each read out display signal the voltage of the read out display signal and determining an appropriate voltage based on the detected voltage and outputting a modulated display signal with the appropriate voltage.

23. The method of claim 22, wherein the step of detecting comprises comparing the voltage of the read out display signal with a reference voltage.

24. The method of claim 20, wherein the step of reading out the display signals comprises a step of simultaneously reading out the display signals retained in every picture element in a currently selected row of said display panel, and the step of re-writing comprises a step of simultaneously re-writing the modulated display signals into every picture element in a currently selected row of said display panel.

* * * * *